US009587862B2

(12) United States Patent
Suzuki et al.

(10) Patent No.: US 9,587,862 B2
(45) Date of Patent: Mar. 7, 2017

(54) CONDENSER

(71) Applicant: KEIHIN THERMAL TECHNOLOGY CORPORATION, Oyama-shi (JP)

(72) Inventors: Shingo Suzuki, Oyama (JP); Kazumi Tokizaki, Oyama (JP); Yoshihiko Seno, Oyama (JP); Takayuki Fujii, Oyama (JP)

(73) Assignee: KEIHIN THERMAL TECHNOLOGY CORPORATION, Oyama-Shi (JP)

( * ) Notice: Subject to any disclaimer, the term of this patent is extended or adjusted under 35 U.S.C. 154(b) by 211 days.

(21) Appl. No.: 14/658,239

(22) Filed: Mar. 16, 2015

(65) Prior Publication Data

US 2015/0184908 A1 Jul. 2, 2015

Related U.S. Application Data

(63) Continuation of application No. 13/291,440, filed on Nov. 8, 2011, now abandoned.

(30) Foreign Application Priority Data

Nov. 8, 2010 (JP) ..... 2010-249466

(51) Int. Cl.
*F25B 39/04* (2006.01)
*F28D 1/053* (2006.01)
(Continued)

(52) U.S. Cl.
CPC ..... *F25B 39/04* (2013.01); *F28D 1/05391* (2013.01); *F28F 1/126* (2013.01);
(Continued)

(58) Field of Classification Search
None
See application file for complete search history.

(56) References Cited

U.S. PATENT DOCUMENTS 6,260,379 B1 7/2001 Manwill et al.
2003/0110793 A1 6/2003 Oh et al.
(Continued)

FOREIGN PATENT DOCUMENTS

JP 2005-315501 11/2005
WO WO 2010/047320 4/2010

OTHER PUBLICATIONS

Japanese Office Action mailed Jun. 17, 2014 for corresponding Japanese Patent Application No. 2010-249466.

*Primary Examiner* — Allen Flanigan
(74) *Attorney, Agent, or Firm* — Mori & Ward, LLP

(57) ABSTRACT

A condenser includes a first header tank, a second header tank, a third header tank, a plurality of first heat exchange tubes, a plurality of second heat exchange tubes, a refrigerant passable tubular body, and a desiccant container. The first header tank is provided on one side of the condenser and has a gas-liquid separation function. The plurality of first heat exchange tubes extend in an extending direction between the first header tank and the third header tank to connect the first header tank and the third header tank. The refrigerant passable tubular body is provided in the first header tank. An upper end of the refrigerant passable tubular body is located above an upper end of the plurality of first heat exchange tubes. The desiccant container is provided above the refrigerant passable tubular body in the first header tank.

9 Claims, 7 Drawing Sheets

(51) Int. Cl.
*F28F 1/12* (2006.01)
*F28F 9/02* (2006.01)

(52) U.S. Cl.
CPC .... *F28F 9/0212* (2013.01); *F25B 2339/0441* (2013.01); *F25B 2339/0442* (2013.01)

(56) References Cited

U.S. PATENT DOCUMENTS

2005/0126210 A1 6/2005 Knecht et al.
2011/0186277 A1 8/2011 Hanafusa

CONDENSER

CROSS-REFERENCE TO RELATED APPLICATIONS

The present application is a continuation application of the U.S. patent application Ser. No. 13/291,440 filed Nov. 8, 2011, which claims priority to Japanese Patent Application No. 2010-249466, filed on Nov. 8, 2010. The contents of these applications are incorporated herein by reference in their entirety.

BACKGROUND OF THE INVENTION

Field of the Invention

The present invention relates to a condenser.

Discussion of the Background

Herein and in the appended claims, the upper side, lower side, left-hand side, and right-hand side of FIG. 1 will be referred to as "upper," "lower," "left," and "right," respectively.

A condenser for a car air conditioner which can reduce installation space has been demanded. In order to meet such a demand, the applicant of the present invention has proposed a condenser which can reduce installation space (see the pamphlet of WO2010/047320). The proposed condenser includes a plurality of heat exchange tubes disposed in parallel such that they are spaced apart from one another in a vertical direction and extend in a left-right direction; and header tanks which extend in the vertical direction and to which left and right end portions of the heat exchange tubes are connected, respectively. Three or more heat exchange paths each formed by a plurality of heat exchange tubes successively arranged in the vertical direction are provided such that the heat exchange paths are juxtaposed in the vertical direction. Refrigerant flows in the same direction through all the heat exchange tubes which form each heat exchange path, and the flow direction of refrigerant flowing through the heat exchange tubes which form one of two adjacent heat exchange paths is opposite the flow direction of refrigerant flowing through the heat exchange tubes which form the other heat exchange path. A first header tank and a second header tank are individually provided at the left end or right end. First heat exchange tubes which form at least two successively arranged heat exchange paths, including the heat exchange path at the lower end, are connected to the first header tank. Second heat exchange tubes which form the heat exchange paths provided above the heat exchange paths formed by the first heat exchange tubes connected to the first header tank are connected to the second header tank. The first header tank is disposed on the outer side of the second header tank with respect to the left-right direction, and the upper end of the first header tank is located above the lower end of the second header tank. The first header tank has a function of separating gas and liquid from each other by making use of gravitational force and storing the separated liquid. The upper-end heat exchange path, among the heat exchange paths formed by the first heat exchange tubes connected to the first header tank, and the heat exchange paths formed by the second heat exchange tubes connected to the second header tank serve as refrigerant condensation paths for condensing refrigerant. The heat exchange paths formed by the first heat exchange tubes connected to the first header tank, excluding the upper end heat exchange path, serve as refrigerant super-cooling paths for super-cooling refrigerant.

Incidentally, the condenser disclosed in the pamphlet has been desired to be designed such that, when refrigerant is charged, the amount of refrigerant charged into a refrigeration cycle reaches, in an earlier stage, a proper level at which the degree of super-cooling becomes constant.

SUMMARY OF THE INVENTION

According to one aspect of the present invention, a condenser includes a first header tank, a second header tank, a third header tank, a plurality of first heat exchange tubes, a plurality of second heat exchange tubes, a refrigerant passable tubular body, and a desiccant container. The first header tank is provided on one side of the condenser and has a gas-liquid separation function. The second header tank is provided on the one side of the condenser. An upper end of the first header tank is located above a lower end of the second header tank. The third header tank is provided on another side of the condenser opposite to the one side. The plurality of first heat exchange tubes extend in an extending direction between the first header tank and the third header tank to connect the first header tank and the third header tank. The plurality of first heat exchange tubes are directly connected to the first header tank. The plurality of second heat exchange tubes extend in the extending direction between the second header tank and the third header tank to connect the second header tank and the third header tank. The plurality of first heat exchange tubes are longer than the plurality of second heat exchange tubes. The refrigerant passable tubular body is provided in the first header tank. An upper end of the refrigerant passable tubular body is located above an upper end of the plurality of first heat exchange tubes. The desiccant container is provided above the refrigerant passable tubular body in the first header tank.

DESCRIPTION OF THE EMBODIMENT

An embodiment of the present invention will next be described with reference to the drawings.

Figure 1:
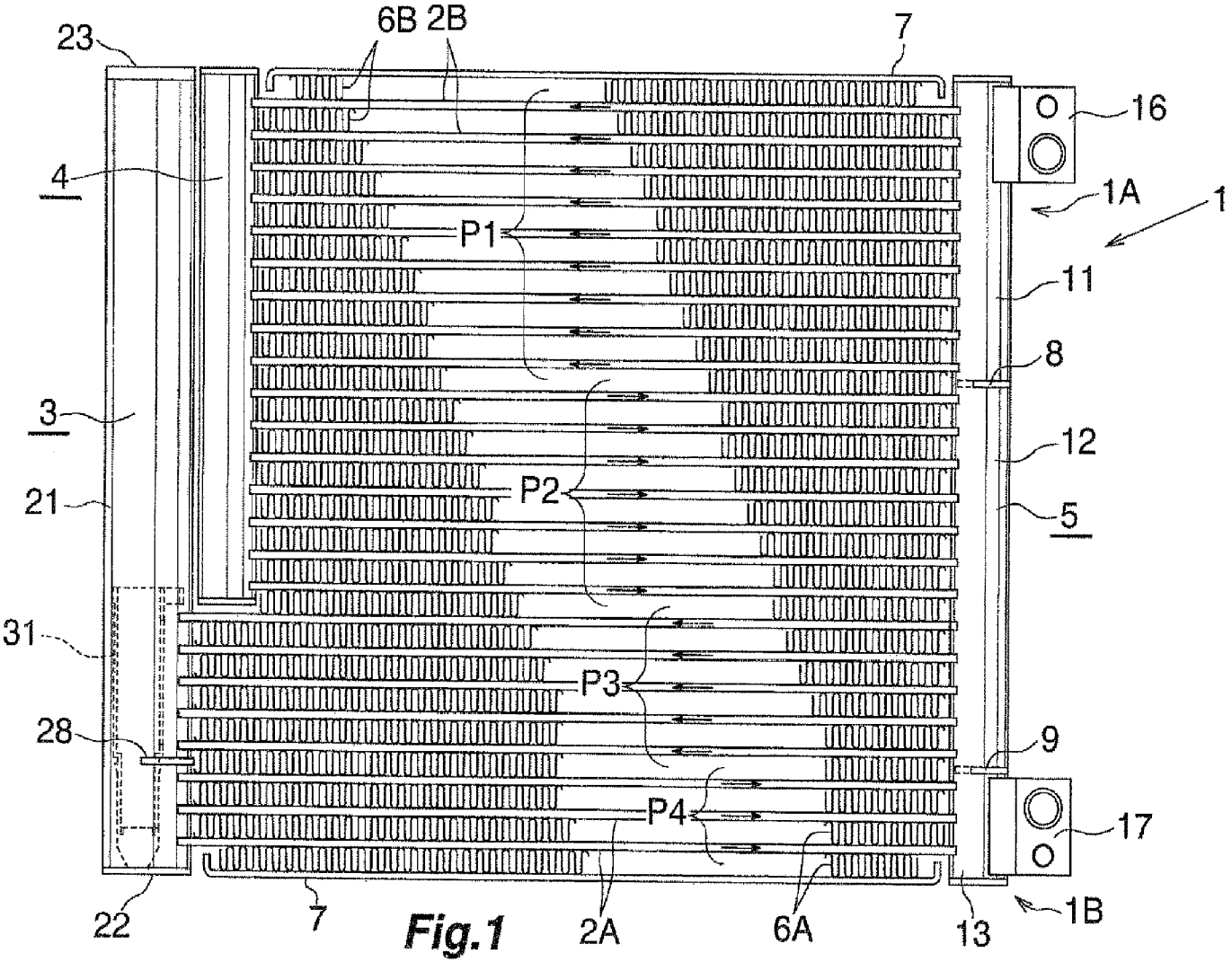
FIG. 1 is a front view specifically showing the overall structure of the condenser according to an embodiment of the present invention.

In the following description, the reverse side of a sheet on which FIG. 1 is drawn (the upper side in FIG. 4) will be referred to as the "front," and the opposite side as the "rear."

Furthermore, the term "aluminum" as used in the following description encompasses aluminum alloys in addition to pure aluminum.

Figure 2:
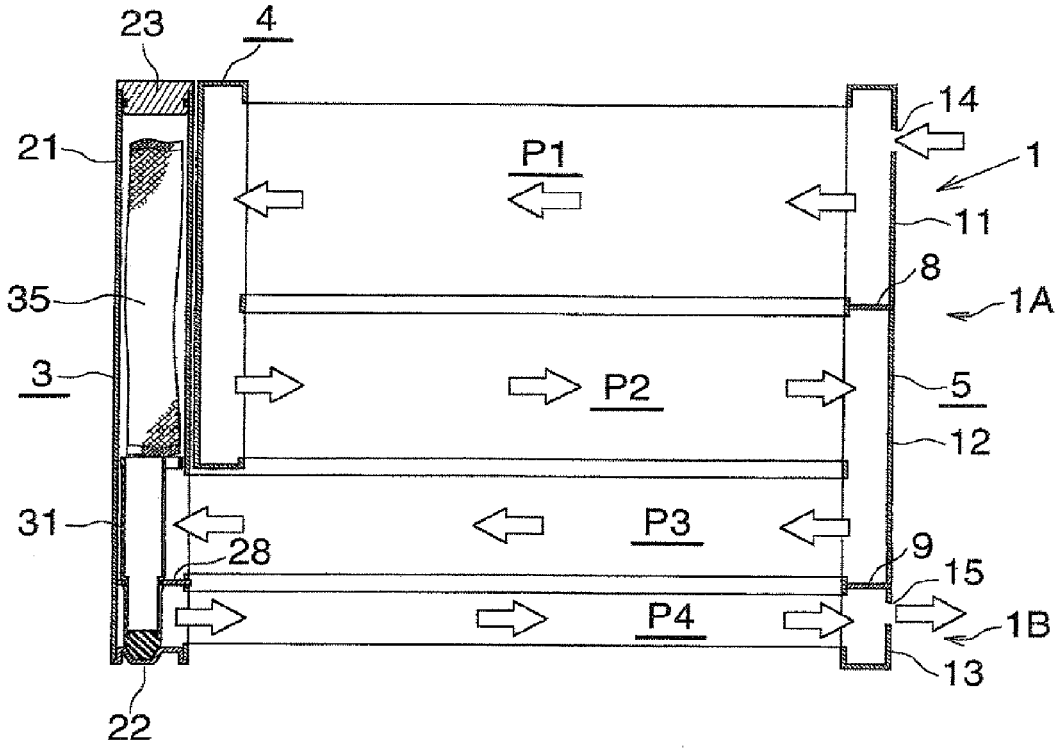
FIG. 2 is a front view schematically showing the condenser of FIG. 1.
Figure 3:
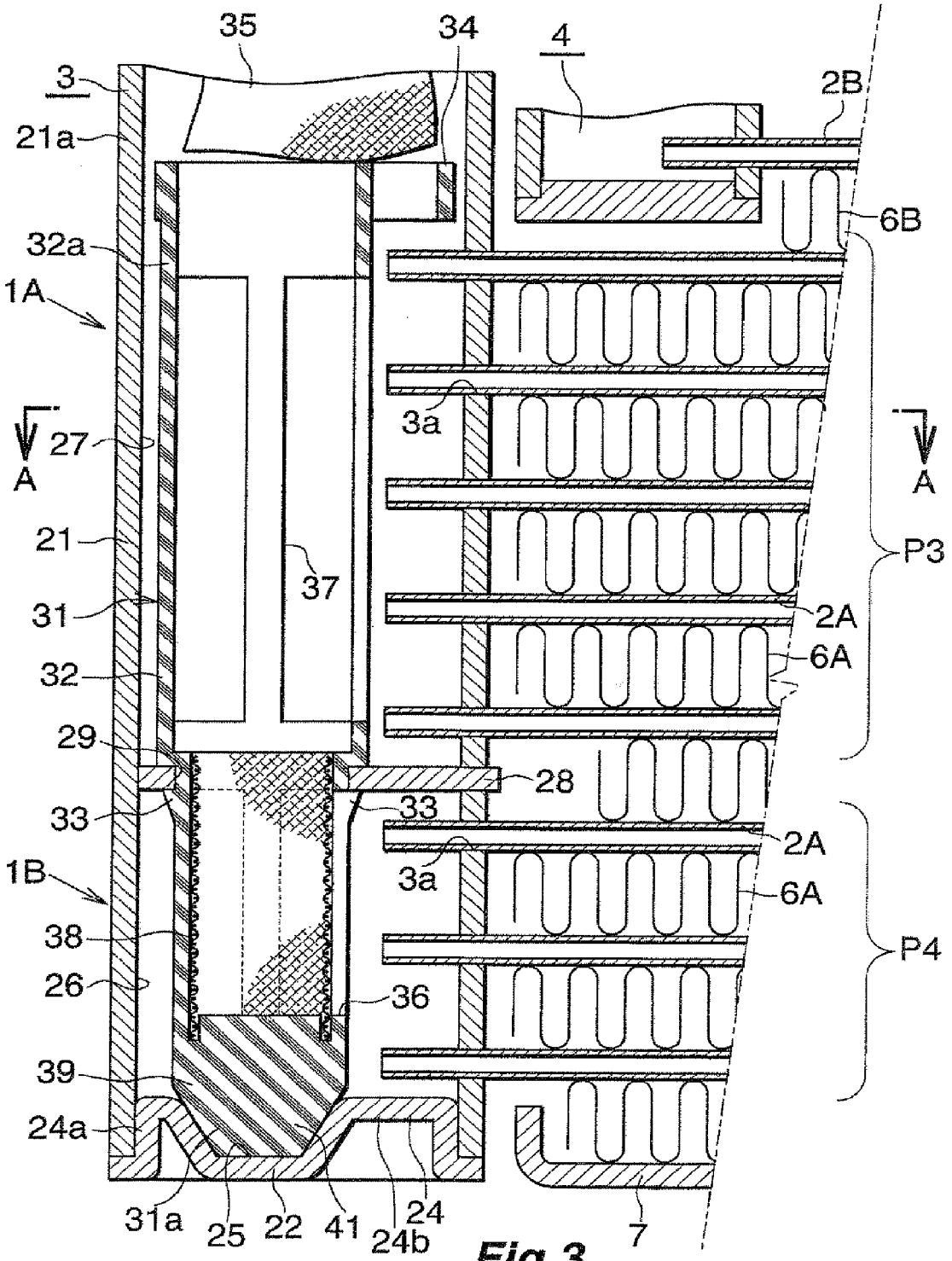
FIG. 3 is a partially omitted vertical sectional view showing, on an enlarged scale, a portion of a first header tank of the condenser shown in FIG. 1.
Figure 5:
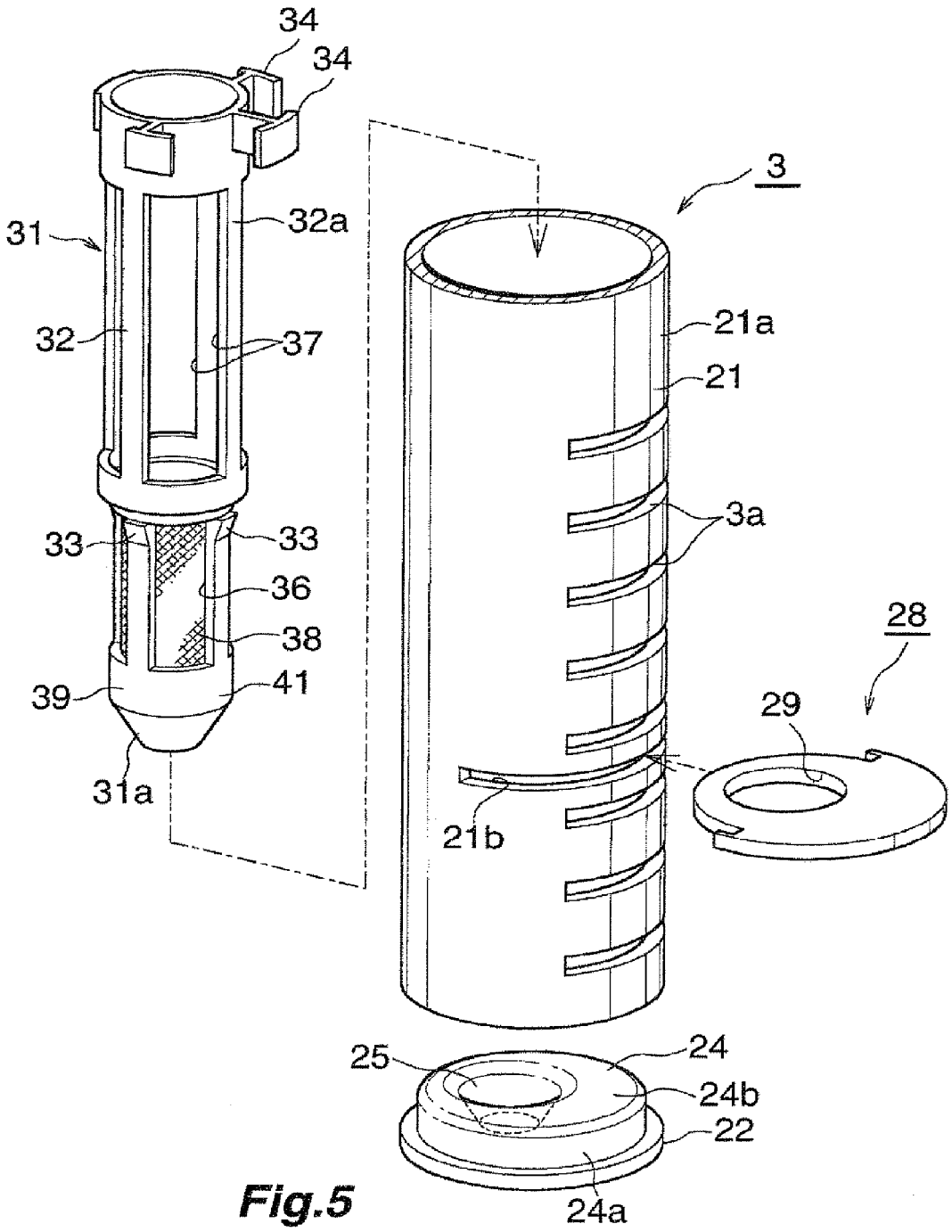
FIG. 5 is an exploded perspective view showing a portion of the first header tank of the condenser shown in FIG. 1, and a refrigerant passable tubular body.

FIG. 1 specifically shows the overall structure of a condenser according to the embodiment of the present invention; and FIG. 2 schematically shows the condenser of the embodiment of the present invention. In FIG. 2, individual heat exchange tubes are omitted, and corrugate fins, side plates, a refrigerant inlet member, and a refrigerant outlet member are also omitted. FIGS. 3 and 5 show the structure of a main portion of the condenser of FIG. 1.

In FIG. 1, a condenser 1 includes a plurality of flat heat exchange tubes 2A, 2B formed of aluminum, three header tanks 3, 4, 5 formed of aluminum, corrugate fins 6A, 6B formed of aluminum, and side plates 7 formed of aluminum. The heat exchange tubes 2A, 2B are disposed such that their width direction coincides with a front-rear direction, their length direction coincides with a left-right direction, and they are spaced from one another in a vertical direction. Left and right end portions of the heat exchange tubes 2A, 2B are connected, by means of brazing, to the header tanks 3, 4, 5, which extend in the vertical direction. Each of the corrugate fins 6A, 6B is disposed between and brazed to adjacent heat exchange tubes 2A, 2B, or is disposed on the outer side of the uppermost or lowermost heat exchange tube 2A, 2B and brazed to the corresponding heat exchange tube 2A, 2B. The side plates 7 are disposed on the corresponding outer sides of the uppermost and lowermost corrugate fins 6A, 6B, and are brazed to these corrugate fins 6A, 6B. Three or more heat exchange paths (in the present embodiment, four heat exchange paths P1, P2, P3, P4) each formed by a plurality of heat exchange tubes 2A, 2B successively arranged in the vertical direction are juxtaposed in the vertical direction. The four heat exchange paths will be referred to as the first to fourth heat exchange paths P1, P2, P3, P4 from the upper side. The flow direction of refrigerant is the same among all the heat exchange tubes 2A, 2B which form the respective heat exchange paths P1, P2, P3, P4. The flow direction of refrigerant in the heat exchange tubes 2A, 2B which form a certain heat exchange path is opposite the flow direction of refrigerant in the heat exchange tubes 2A, 2B which form another heat exchange path adjacent to the certain heat exchange path. Left and right end portions of the heat exchange tubes 2A, 2B are brazed to the header tanks 3, 4, 5 in a state in which they are inserted into tube insertion holes 3*a* (see FIGS. 3 to 5) of the header tanks 3, 4, 5.

As shown in FIGS. 1 and 2, a first header tank 3 and a second header tank 4 are individually provided at the left end of the condenser 1. The heat exchange tubes 2A, which form at least two successively arranged heat exchange paths, including the lower-end heat exchange path, (in the present embodiment, the third and fourth heat exchange paths P3, P4), are connected to the first header tank 3 by means of brazing. The heat exchange tubes 2B, which form the first and second heat exchange paths P1, P2 are connected to the second header tank 4 by means of brazing. The heat exchange tubes 2A connected to the first header tank 3 will be referred to as the first heat exchange tubes, and the heat exchange tubes 2B connected to the second header tank 4 will be referred to as the second heat exchange tubes. The corrugate fins 6A disposed between the adjacent first heat exchange tubes 2A and between the lower-end first heat exchange tube 2A and the lower side plate 7 will be referred to as the first corrugate fins. The corrugate fins 6B disposed between the adjacent second heat exchange tubes 2B and between the upper-end second heat exchange tube 2B and the upper side plate 7 will be referred to as the second corrugate fins.

Although the first header tank 3 and the second header tank 4 are approximately equal to each other in terms of the dimension along the front-rear direction, the first header tank 3 is greater than the second header tank 4 in terms of the horizontal cross sectional area. The first header tank 3 is disposed on the left side (on the outer side with respect to the left-right direction) of the second header tank 4. The center of the first header tank 3 with respect to the left-right direction is located on the outer side (with respect to the left-right direction) of the center of the second header tank 4 with respect to the left-right direction. The centers of the first and second header tanks 3, 4 with respect to the front-rear direction are located on a common vertical plane extending in the left-right direction. Therefore, the first header tank 3 and the second header tank 4 are offset from each other such that they do not overlap as viewed from above. The upper end of the first header tank 3 is located above the lower end of the second header tank 4. In the present embodiment, the upper end of the first header tank 3 is located at a position which is substantially the same height as the upper end of the second header tank 4. Thus, the first header tank 3 serves as a liquid receiver which separates gas and liquid from each other through utilization of gravitational force, and stores the separated liquid. That is, the internal volume of the first header tank 3 is determined such that a portion of gas-liquid mixed phase refrigerant having flowed into the first header tank 3; i.e., liquid-predominant mixed phase refrigerant, accumulates in a lower region within the first header tank 3 because of gravitational force, and the gas phase component of the gas-liquid mixed phase refrigerant accumulates in an upper region within the first header tank 3 because of gravitational force, whereby only the liquid-predominant mixed phase refrigerant flows into the first heat exchange tubes 2A of the fourth heat exchange path P4.

The third header tank 5 is disposed at the right end of the condenser 1, and all the heat exchange tubes 2A, 2B which form the first to fourth heat exchange paths P1-P4 are connected to the third header tank 5. The transverse cross sectional shape of the third header tank 5 is identical with that of the second header tank 4. The interior of the third header tank 5 is divided into an upper header section 11, an intermediate header section 12, and a lower header section 13 by aluminum partition plates 8, 9, which are provided at a height between the first heat exchange path P1 and the second heat exchange path P2 and a height between the third heat exchange path P3 and the fourth heat exchange path P4, respectively. Left end portions of the second heat exchange tubes 2B of the first heat exchange path P1 are connected to the second header tank 4, and right end portions thereof are connected to the upper header section 11 of the third header tank 5. Left end portions of the second heat exchange tubes 2B of the second heat exchange path P2 are connected to the second header tank 4, and right end portions thereof are connected to the intermediate header section 12 of the third header tank 5. Left end portions of the first heat exchange tubes 2A of the third heat exchange path P3 are connected to the first header tank 3, and right end portions thereof are connected to the intermediate header section 12 of the third header tank 5. Left end portions of the first heat exchange tubes 2A of the fourth heat exchange path P4 are connected to the first header tank 3, and right end portions thereof are connected to the lower header section 13 of the third header tank 5.

The second header tank 4, a portion of the first header tank 3 to which the first heat exchange tubes 2A of the third heat exchange path P3 are connected, the upper and intermediate header sections 11 and 12 of the third header tank 5, and the first to third heat exchange paths P1-P3 form a condensation section 1A, which condenses refrigerant. A portion of the first header tank 3 to which the first heat exchange tubes 2A of the fourth heat exchange path P4 are connected, the lower header section 13 of the third header tank 5, and the fourth heat exchange path P4 form a super-cooling section 1B, which super-cools refrigerant. Each of the first to third heat exchange paths P1-P3 serves as a refrigerant condensation path for condensing refrigerant, and the fourth heat exchange path P4 serves as a refrigerant super-cooling path for super-cooling refrigerant.

A refrigerant inlet 14 is formed at the upper header section 11 of the third header tank 5, which partially forms the condensation section 1A, and a refrigerant outlet 15 is formed at the lower header section 13 of the third header tank 5, which partially forms the super-cooling section 1B. A refrigerant inlet member 16 which communicates with the refrigerant inlet 14 and a refrigerant outlet member 17 which communicates with the refrigerant outlet 15 are joined to the third header tank 5.

The first header tank 3 is composed of a cylindrical tubular body 21 having opened upper and lower ends, a lower end closing member 22 (a lower end closing portion), which is brazed to the lower end of the cylindrical tubular body 21, and closes a lower end opening of the cylindrical tubular body 21, and a lid 23, which is removably attached to the upper end of the cylindrical tubular body 21, and closes an upper end opening of the cylindrical tubular body 21. As shown in FIG. 3, the lower end closing member 22 of the first header tank 3 has an inward projecting portion 24, which is composed of a cylindrical tubular portion 24*a* extending along the inner circumferential surface of the circumferential wall of the cylindrical tubular body 21 of the first header tank 3, and a top wall 24*b* integrally formed at the upper end of the cylindrical tubular portion 24*a*. The top wall 24*b* of the inward projecting portion 24 is located below the lower-end first heat exchange tube 2A of the fourth heat exchange path P4. A recess 25 is provided on the upper surface of the inward projecting portion 24 by means of downwardly deforming a portion of the top wall 24*b* in a recess shape. The recess 25 is opened upward and has a conical wall surface tapered such that its diameter decreases downward.

Figure 4:
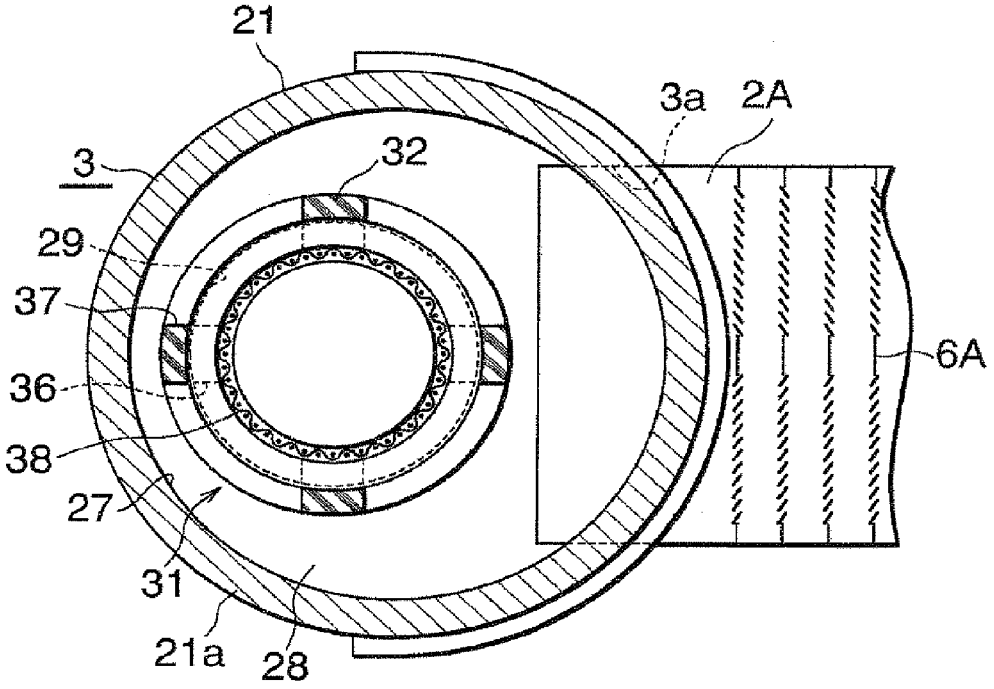
FIG. 4 is a sectional view taken along line A-A of FIG. 3.

As shown in FIGS. 3 to 5, a plate member 28 is fixed to a circumferential wall 21*a* of the cylindrical tubular body 21 of the first header tank 3. The plate member 28 serves as a partition portion for dividing the interior of the first header tank 3 into a first region 26, with which the first heat exchange tubes 2A of the fourth heat exchange path P4 communicate, and a second region 27 located above the first region 26. The plate member 28 is externally inserted into a slit 21*b* formed in the circumferential wall 21*a* of the cylindrical tubular body 21 of the first header tank 3, and is brazed to the circumferential wall 21*a*. The plate member 28 has a circular through hole 29 formed at a position located on the outer side of the center of the plate member 28 with respect to the left-right direction.

A refrigerant passable tubular body 31 and a sack-like desiccant container 35 are disposed within the first header tank 3 such that the desiccant container 35 is located above the refrigerant passable tubular body 31. The refrigerant passable tubular body 31 is formed of a synthetic resin, and has a bottomed cylindrical tubular shape such that its upper end is opened, and its lower end is closed. The desiccant container 35 is formed of a liquid permeable material, and a desiccant (not shown) is placed in the desiccant container 35.

The refrigerant passable tubular body 31 is closely passed through the through hole 29 of the plate member 28 from the upper side thereof such that its upper end is located between the second heat exchange path P2 and the third heat exchange path P3, and its lower end is located below the lower-end first heat exchange tubes 2A of the fourth heat exchange path P4. A lower end portion of the refrigerant passable tubular body 31 is closely fitted into the recess 25 of the inward projecting portion 24 of the lower end closing member 22. A fitting portion 31*a* of the refrigerant passable tubular body 31 closely fitted into the recess 26 has a conical outer circumferential surface tapered such that its diameter decreases downward.

An upper portion 32*a* of the circumferential wall 32 of the refrigerant passable tubular body 31 located above the plate member 28 has an outer diameter greater than the diameter of the through hole 29. On a portion of the outer circumferential surface of the circumferential wall 32 of the refrigerant passable tubular body 31, the portion being located below the plate member 28, a plurality of projections 33 projecting radially outward are integrally formed at predetermined intervals in the circumferential direction. The lower end of the upper portion 32*a* of the circumferential wall 32 is in contact with the upper surface of the plate member 28, and the projections 33 are in contact with the lower surface of the plate member 28, whereby movement of the refrigerant passable tubular body 31 in the vertical direction is prevented. Also, at the upper end of the refrigerant passable tubular body 31, a plurality of outward projecting portions 34, which project radially outward, are integrally formed at predetermined intervals in the circumferential direction. The desiccant container 35 is supported by the upper end of the circumferential wall 32 and the outward projecting portions 34.

At least a portion (in the present embodiment, a lower portion) of the refrigerant passable tubular body 31 is located in the first region 26, which communicates with the first heat exchange tubes 2A of the fourth heat exchange path P4 (a refrigerant super-cooling path adjacent to the lower-end refrigerant condensation path), and an upper end portion of the refrigerant passable tubular body 31 is located in a portion of the second region 27, which communicates with the first heat exchange tubes 2A of the third heat exchange path P3 (the lower-end refrigerant condensation path).

The circumferential wall 32 of the refrigerant passable tubular body 31 has a plurality of vertically elongated first communication openings 36 and a plurality of vertically elongated second communication openings 37, which are formed at predetermined intervals in the circumferential direction. The first communication openings 36 are opened to the first region 26 of the interior of the first header tank 3 located below the plate member 28, and the second communication openings 37 are opened to the second region 27 of the interior of the first header tank 3 located above the plate member 28. The first communication openings 36 are covered with a mesh filter 38. The first and second communication openings 36, 37 account for the greater part of the circumferential wall 32 of the refrigerant passable tubular body 31. Preferably, the mesh size of the mesh filter 38 covering the first communication openings 36 is such that 100 or more meshes are present over a length of 1 inch. The filter 38 may be formed integrally with the circumferential wall 32 of the refrigerant passable tubular body 31. Alternatively, the filter 38 may be formed separately from the circumferential wall 32 of the refrigerant passable tubular body 31, and fixed to the circumferential wall 32.

The fitting portion 31*a* of the refrigerant passable tubular body 31, which is closely fitted into the recess 25 of the inward projecting portion 24 of the lower end closing member 22, and a portion of the refrigerant passable tubular body 31 extending upward from the fitting portion 31*a* are solid, whereby a refrigerant entry prevention portion 39 for preventing entry of refrigerant from the first region 26 is formed at the lower end of the refrigerant passable tubular body 31. The refrigerant entry prevention portion 39, formed at the lower end of the refrigerant passable tubular body 31, and a portion of the circumferential wall 32 located below the plate member 28 constitute an internal volume reduction portion 41 for reducing the internal volume of the first region 26 of the first header tank 3. Thus, the internal volume reduction portion 41 for reducing the internal volume of the first header tank 3 is provided in the first region 26 of the interior of the first header tank 3, which communicates with the first heat exchange tubes 2A of the fourth heat exchange path P4. Notably, the refrigerant entry prevention portion 39, which is formed at the lower end of the refrigerant passable tubular body 31 and partially constitutes the internal volume reduction portion 41, is not limited to a solid one, and the refrigerant entry prevention portion 39 may include a hollow space isolated from the first region 26.

The condenser 1 is manufactured as follows. After all the components, excluding the refrigerant passable tubular body 31, the desiccant container 35, and the lid 23, are brazed together, the refrigerant passable tubular body 31 and the desiccant container 35 are placed in the cylindrical tubular body 21 of the first header tank 3 from above, and the lid 23 is attached to the cylindrical tubular body 21. Thus, the condenser 1 is completed. When the refrigerant passable tubular body 31 is inserted into the cylindrical tubular body 21, the projections 33 of the refrigerant passable tubular body 31 deform, and then regain their original shapes after having passed through the through hole 29 of the plate member 28.

The condenser 1 constitutes a refrigeration cycle in cooperation with a compressor, an expansion valve (pressure reducer), and an evaporator; and the refrigeration cycle is mounted on a vehicle as a car air conditioner.

In the condenser 1 having the above-described structure, gas phase refrigerant of high temperature and high pressure compressed by the compressor flows into the upper header section 11 of the third header tank 5 via the refrigerant inlet member 16 and the refrigerant inlet 14. The gas phase refrigerant is partially condensed while flowing leftward within the second heat exchange tubes 2B of the first heat exchange path P1, and then flows into the second header tank 4. The refrigerant having flowed into the second header tank 4 is partially condensed while flowing rightward within the second heat exchange tubes 2B of the second heat exchange path P2, and then flows into the intermediate header section 12 of the third header tank 5. The refrigerant having flowed into the intermediate header section 12 of the third header tank 5 is partially condensed while flowing leftward within the first heat exchange tubes 2A of the third heat exchange path P3, and then flows into the first header tank 3.

The refrigerant having flowed into the first header tank 3 is gas-liquid mixed phase refrigerant. A portion of the gas-liquid mixed phase refrigerant; i.e., liquid-predominant mixed phase refrigerant, accumulates in a lower region within the first header tank 3 because of gravitational force, and enters the first heat exchange tubes 2A of the fourth heat exchange path P4.

The liquid-predominant mixed phase refrigerant having entered the first heat exchange tubes 2A of the fourth heat exchange path P4 is super-cooled while flowing rightward within the first heat exchange tubes 2A. After that, the super-cooled refrigerant enters the lower header section 13 of the third header tank 5, and flows out via the refrigerant outlet 15 and the refrigerant outlet member 17. The refrigerant is then fed to the evaporator via the expansion valve.

Meanwhile, the gas phase component of the gas-liquid mixed phase refrigerant having flowed into the first header tank 3 accumulates in an upper region within the first header tank 3.

The refrigerant passable tubular body 31 partially forms the internal volume reduction portion 41 provided in the first region 26 of the interior of the first header tank 3 located below the plate member 28. Therefore, when the refrigerant is charged into the above-described car air conditioner, the liquid-phase refrigerant easily accumulates in the first region 26 of the interior of the first header tank 3 up to a level equal to or higher than the upper-end first heat exchange tube 2A of the fourth heat exchange path P4, which is a refrigerant super-cooling path and which is located adjacent to and on the lower side of the third heat exchange path P3, which is a refrigerant condensation path. Accordingly, at the time of refrigerant charging, the interiors of the first heat exchange tubes 2A of the fourth heat exchange path P4 can be quickly filled with the liquid-phase refrigerant. As a result, the amount of refrigerant charged into the refrigeration cycle can be increased, in an early stage, to a proper level at which the degree of super-cooling becomes constant. In addition, since the width of a stabilized range in which the degree of super-cooling becomes constant; i.e., a range of the refrigerant charging amount which renders the degree of super-cooling constant, becomes wider, a super-cooling characteristic which is more stable against variation of load and leakage of refrigerant can be obtained.

Figure 6:
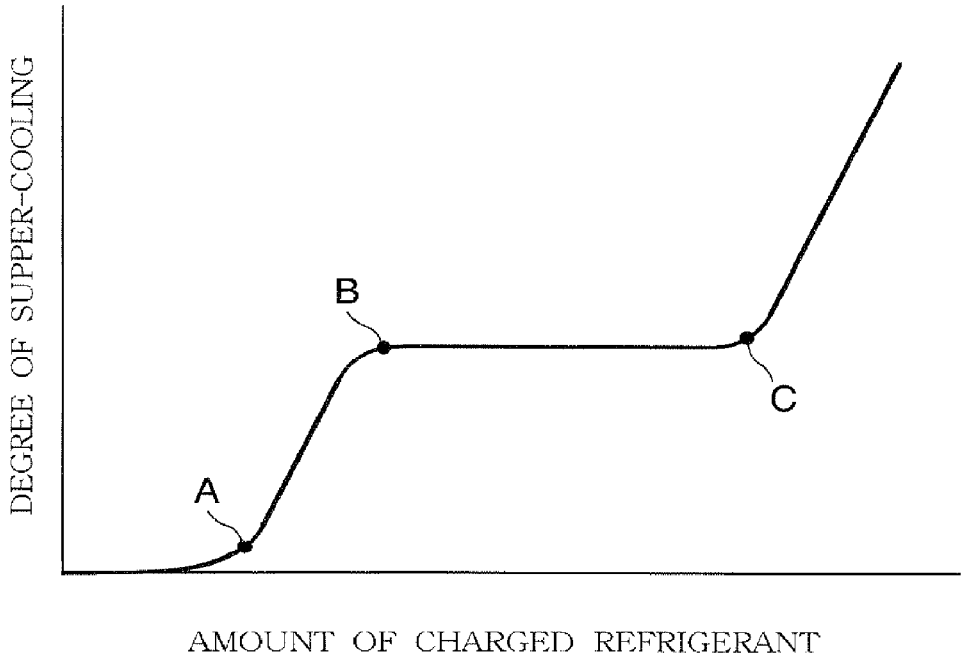
FIG. 6 is a graph showing the amount of charged refrigerant and the degree of supper-cooling in the condenser shown in FIG. 1.

The above-described effects were confirmed through a test. Specifically, a predetermined amount of refrigerant was first charged into a refrigeration cycle composed of the condenser 1, a compressor, an expansion valve, and an evaporator, and operation of the refrigeration cycle was started. While the refrigerant was gradually added, the degree of super-charging was measured at different refrigerant charging amounts. A charge graph showing the relation between the refrigerant charging amount and the degree of super-charging was drawn. As shown in FIG. 6, in the graph, point A represents a point at which the super-cooling of refrigerant flowing out of the condenser 1 was started, point B represents a point at which the interiors of the first heat exchange tubes 2A of the fourth heat exchange path P4 of the condenser 1 were filled with liquid-phase refrigerant, and point C represents a point at which the interior of the first header tank 3 of the condenser 1 was filled with liquid-phase refrigerant. As can be understood from this graph, the amount of refrigerant charged into the refrigeration cycle can be increased, in an early stage, to a proper level at which the degree of super-cooling becomes constant. In addition, since the width of a stabilized range in which the degree of super-cooling becomes constant; i.e., a range of the refrigerant charging amount which renders the degree of super-cooling constant, becomes wider, a super-cooling characteristic which is more stable against variation of load and leakage of refrigerant can be obtained.

Figure 7:
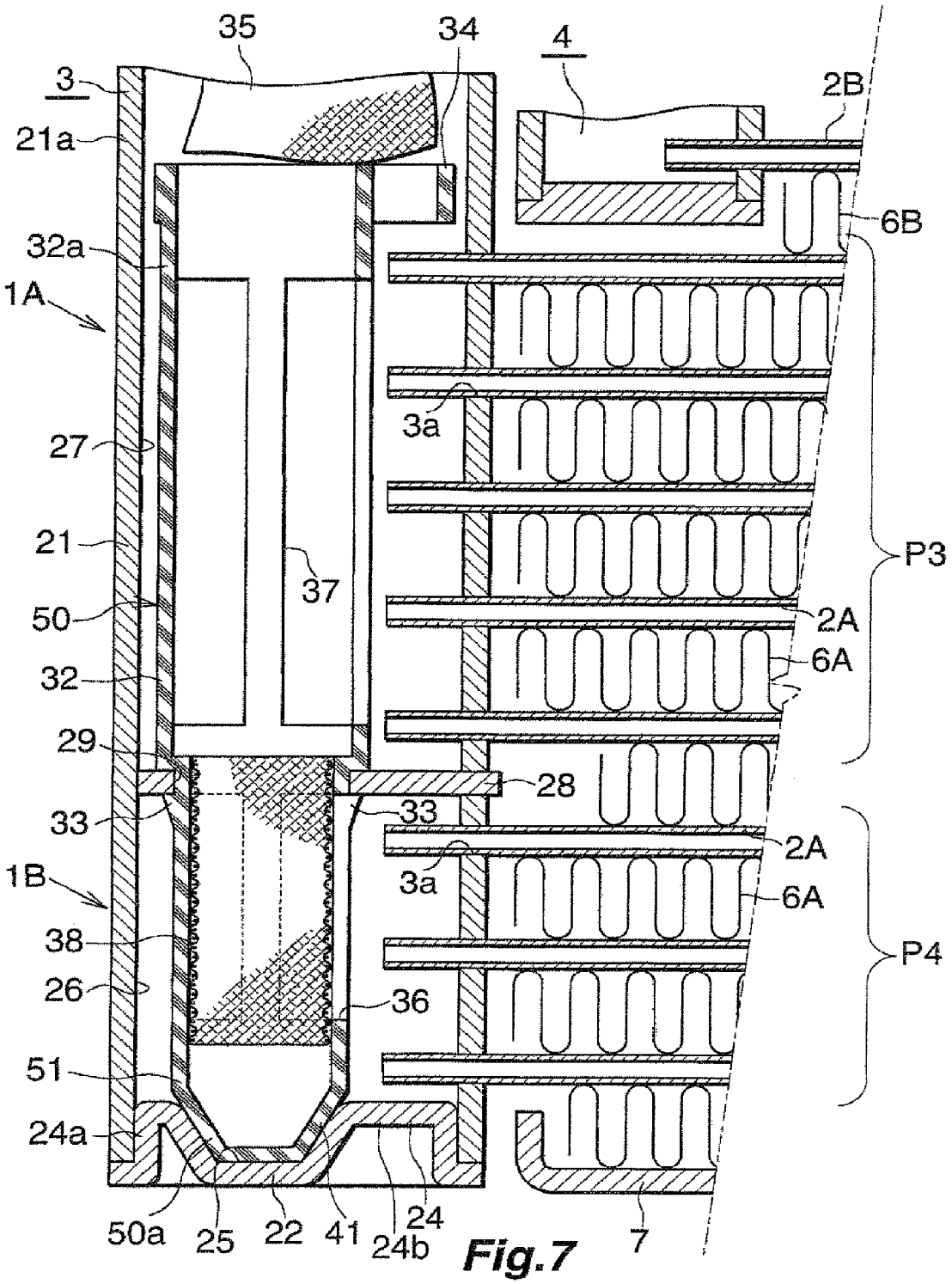
FIG. 7 is a view corresponding to FIG. 3 and showing a modification of the refrigerant passable tubular body.

FIG. 7 shows a modification of the refrigerant passable tubular body.

In the case of a refrigerant passable tubular body 50 shown in FIG. 7, a fitting portion 50*a* closely fitted into the recess 25 of the lower end closing member 22 of the first header tank 3 has a conical outer circumferential surface tapered such that its diameter decreases downward. The fitting portion 50*a* of the refrigerant passable tubular body 50 and a portion of the circumferential wall 32 of the refrigerant passable tubular body 50, the portion extending upward from the fitting portion 50*a*, form a hollow portion 51 which has a closed lower end and is opened upward. A portion of the circumferential wall 32 of the refrigerant passable tubular body 50, the portion being located below the plate member 28 and including the hollow portion 51, serves as the internal volume reduction portion 41, which reduces the internal volume of the first header tank 3 and which is provided in the first region 26, which communicates with the first heat exchange tubes 2A of the fourth heat exchange path P4.

The structure of the remaining portion of the refrigerant passable tubular body 50 is the same as that of the above-described refrigerant passable tubular body 31, and the refrigerant passable tubular body 50 is placed in the first header tank 3 in the same manner as the refrigerant passable tubular body 31. Notably, portions and members of the refrigerant passable tubular body 50 identical with those of the above-described refrigerant passable tubular body 31 are denoted by the same reference numerals.

The embodiment of the present invention includes the following modes.

1) A condenser including a plurality of heat exchange tubes disposed in parallel such that the heat exchange tubes are spaced apart from one another in a vertical direction and extend in a left-right direction; and header tanks which extend in the vertical direction and to which left and right end portions of the heat exchange tubes are connected, in which three or more heat exchange paths each formed by a plurality of heat exchange tubes successively arranged in the vertical direction are juxtaposed in the vertical direction, wherein first and second header tanks are provided at a left or right end of the condenser, first heat exchange tubes which form at least two successively arranged heat exchange paths including a heat exchange path located at the lower end being connected to the first header tank, and second heat exchange tubes which form heat exchange paths provided above the heat exchange paths formed by the first heat exchange tubes connected to the first header thank being connected to the second header tank;

the first header tank is disposed on the outer side of the second header tank with respect to the left-right direction, has an upper end located above a lower end of the second header tank, and has a function of separating gas and liquid from each other and storing the liquid by making use of gravitational force;

an upper-end heat exchange path among the heat exchange paths formed by the first heat exchange tubes connected to the first header tank, and the heat exchange paths formed by the second heat exchange tubes connected to the second header tank serve as refrigerant condensation paths for condensing refrigerant; and a heat exchange path formed by some of the first heat exchange tubes connected to the first header tank, other than the upper-end heat exchange path, serves as a refrigerant super-cooling path for super-cooling refrigerant, wherein an internal volume reduction portion for reducing an internal volume of the first header tank is provided in a region of the interior of the first header tank which region communicates with the first heat exchange tubes of the refrigerant super-cooling path.

2) A condenser according to par. 1), wherein a refrigerant passable tubular body is disposed in the first header tank, and a portion of the refrigerant passable tubular body constitutes at least a portion of the internal volume reduction portion.

3) A condenser according to par. 2), wherein a lower end closing portion of the first header tank has an inward projecting portion having a recess formed on an upper surface thereof, and a lower end portion of the refrigerant passable tubular body is fitted into the recess.

4) A condenser according to par. 3), wherein a refrigerant entry prevention portion is provided at least at the portion of the refrigerant passable tubular body fitted into the recess, and the inward projecting portion of the lower end closing portion of the first header tank and the refrigerant entry prevention portion of the refrigerant passable tubular body constitute at least a portion of the internal volume reduction portion.

5) A condenser according to par. 2), wherein a partition portion is provided in the first header tank so as to divide the interior of the first header tank into upper and lower regions, a through hole is formed in the partition portion, and the refrigerant passable tubular body is passed through the through hole of the partition portion.

6) A condenser according to par. 5), wherein the partition portion divides the interior of the first header tank into a first region which communicates with the first heat exchange tubes of a refrigerant super-cooling path located adjacent to and downward of the refrigerant condensation path associated with the first header tank, and a second region located above the first region; at least a portion of the refrigerant passable tubular body is located in the first region of the interior of the first header tank; the refrigerant passable tubular body has a first communication opening opened to the first region and a second communication opening opened to the second region; and at least one of the first and second communication openings is covered with a filter.

7) A condenser according to par. 1), wherein the first heat exchange tubes which form two heat exchange paths are connected to the first header tank, and the second heat exchange tubes which form at least two heat exchange paths are connected to the second header tank.

According to the condensers of pars. 1) to 7), an internal volume reduction portion for reducing the internal volume of the first header tank is provided in a region within the first header tank, which region communicates with the first heat exchange tubes of the refrigerant super-cooling path. Therefore, at the time of refrigerant charging, liquid-phase refrigerant easily accumulates within the first header tank up to a level equal to or higher than the upper-end heat exchange tube of the refrigerant super-cooling path located adjacent to and downward of the refrigerant condensation path associated with the first header tank. Accordingly, at the time of refrigerant charging, the interiors of the first heat exchange tubes of the refrigerant super-cooling path can be quickly filled with the liquid-phase refrigerant. As a result, the amount of refrigerant charged into the refrigeration cycle can be increased, in an early stage, to a proper level at which the degree of super-cooling becomes constant. In addition, since the width of a stabilized range in which the degree of super-cooling becomes constant; i.e., a range of the refrigerant charging amount which renders the degree of super-cooling constant, becomes wider, a super-cooling characteristic which is more stable against variation of load and leakage of refrigerant can be obtained.

According to the condenser of par. 2), the internal volume reduction portion can be provided in the first header tank relatively easily.

According to the condenser of par. 3), when the condenser is used for an air conditioner of an automobile, vibration of the refrigerant passable tubular body caused by vibration of the automobile and flow of refrigerant can be suppressed.

According to the condenser of par. 4), the internal volume reduction portion can be provided in the first header tank relatively easily.

According to the condenser of par. 5), when the condenser is used for an air conditioner of an automobile, vibration of the refrigerant passable tubular body caused by vibration of the automobile and flow of refrigerant can be suppressed.

According to the condenser of par. 6), through the action of the filter, flow of a desiccant or a foreign substance from the first header tank can be prevented.

According to the condenser of par. 7), refrigerant flows into the first header tank from a plurality of heat exchange tubes which constitute the refrigerant condensation path located at the lower end, and gas liquid separation is performed within the first header tank. Therefore, it is possible to suppress a drop in pressure, to thereby prevent re-vaporization of liquid-phase refrigerant.

What is claimed is:

1. A condenser comprising:

a first header tank provided on one side of the condenser and having a gas-liquid separation function;

a second header tank provided on the one side of the condenser, an upper end of the first header tank being located above a lower end of the second header tank;

a third header tank provided on another side of the condenser opposite to the one side;

a plurality of first heat exchange tubes extending in an extending direction between the first header tank and the third header tank to connect the first header tank and the third header tank, the plurality of first heat exchange tubes being directly connected to the first header tank;

a plurality of second heat exchange tubes extending in the extending direction between the second header tank and the third header tank to connect the second header tank and the third header tank, the plurality of first heat exchange tubes being longer than the plurality of second heat exchange tubes;

a refrigerant passable tubular body provided in the first header tank, an upper end of the refrigerant passable tubular body being located above an upper end of the plurality of first heat exchange tubes; and a desiccant container provided above the refrigerant passable tubular body in the first header tank;

wherein the refrigerant passable tubular body has a plurality of outward projecting portions projecting outward in an radial direction of the refrigerant passable tubular body at the upper end of the refrigerant passable tubular body located above the upper end of the plurality of first heat exchange tubes, and wherein the desiccant container is supported by the upper end of the refrigerant passable tubular body and the plurality of outward projecting portions.

2. The condenser according to claim 1, further comprising:

a partition portion provided in the first header tank so as to divide an interior of the first header tank into upper and lower regions, wherein a through hole is provided in the partition portion, and wherein the refrigerant passable tubular body is passed through the through hole of the partition portion.

3. The condenser according to claim 2, wherein the partition portion divides the interior of the first header tank into a first region and a second region, wherein the first region communicates with first tubes among the plurality of first heat exchange tubes, the first tubes constituting a refrigerant super-cooling path located adjacent to and downward of a refrigerant condensation path associated with the first header tank, wherein the second region is located above the first region, wherein at least a portion of the refrigerant passable tubular body is located in the first region of the interior of the first header tank, wherein the refrigerant passable tubular body has a first communication opening opened to the first region and a second communication opening opened to the second region, and wherein at least one of the first and second communication openings is covered with a filter.

4. The condenser according to claim 1, wherein the plurality of first heat exchange tubes which provide two heat exchange paths are connected to the first header tank, and wherein the plurality of second heat exchange tubes which provide at least two heat exchange paths are connected to the second header tank.

5. The condenser according to claim 1, wherein the first header tank and the second header tank are positionally shifted from each other.

6. The condenser according to claim 1, wherein the upper end of the first header tank is located at a position which is substantially a same height as an upper end of the second header tank.

7. The condenser according to claim 1, wherein a lower end of the refrigerant passable tubular body is located below a lower end of the plurality of first heat exchange tubes.

8. The condenser according to claim 1, wherein the upper end of the refrigerant passable tubular body is opened and a lower end of the refrigerant passable tubular body is closed.

9. The condenser according to claim 1, wherein the refrigerant passable tubular body has no contact with the plurality of first heat exchange tubes.

* * * * *